United States Patent [19]

Hirano et al.

[11] Patent Number: 4,766,852

[45] Date of Patent: Aug. 30, 1988

[54] COOLING SYSTEM FOR AUTOMOTIVE ENGINE OR THE LIKE

[75] Inventors: Yoshinori Hirano, Yokohama; Takao Kubozuka, Yokosuka, both of Japan

[73] Assignee: Nissan Motor Co., Ltd., Yokohama, Japan

[21] Appl. No.: 35,514

[22] Filed: Apr. 7, 1987

[30] Foreign Application Priority Data

Apr. 11, 1986 [JP] Japan ..... 61-83668

[51] Int. Cl.[4] ..... F01P 3/22

[52] U.S. Cl. ..... 123/41.21

[58] Field of Search ..... 123/41.2–41.27

[56] References Cited

U.S. PATENT DOCUMENTS

| | | | |
|---|---|---|---|
| 1,787,562 | 1/1936 | Barlow | 123/41.03 |
| 4,367,699 | 1/1983 | Evans | 123/41.23 |
| 4,499,866 | 2/1985 | Hirano | 123/41.21 |
| 4,545,335 | 10/1985 | Hayashi | 123/41.27 |
| 4,549,505 | 10/1985 | Hirano | 123/41.08 |
| 4,570,579 | 2/1986 | Hirano | 123/41.02 |
| 4,616,602 | 10/1986 | Hirano et al. | 123/41.27 |
| 4,664,073 | 5/1987 | Hirano | 123/41.27 |
| 4,667,626 | 5/1987 | Hayashi et al. | 123/41.27 |

FOREIGN PATENT DOCUMENTS

| | | |
|---|---|---|
| 0059423 | 9/1982 | European Pat. Off. . |
| 32026 | 4/1981 | Japan . |

*Primary Examiner*—Tony M. Argenbright
*Assistant Examiner*—Eric R. Carlberg
*Attorney, Agent, or Firm*—Foley & Lardner, Schwartz, Jeffery, Schwaab, Mack, Blumenthal & Evans

[57] ABSTRACT

An evaporative cooling system features a reservoir which contains only sufficient coolant to fill the radiator when the engine is not in use and thus reduces the weight of the system. The remaining sections of the cooling circuit such as the upper section of the coolant jacket which are fairly resistant to corrosion are filled with air during non-use periods. The air is suitably purged out during engine warm-up and operation in accordance with the temperature differential which exists between the coolant jacket and the bottom of the radiator.

15 Claims, 7 Drawing Sheets

COOLING SYSTEM FOR AUTOMOTIVE ENGINE OR THE LIKE

BACKGROUND OF THE INVENTION

1. Field of the Invention

The present invention relates generally to an evaporative type cooling system for an internal combustion engine wherein liquid coolant is permitted to boil and the vapor used as a vehicle for removing heat therefrom, and more specifically to such a system which minimizes the total amount of liquid coolant which is required for all modes of operation (including non-use) and which simultaneously obviates rusting of essentially all of the components of the system prone to oxidation by atmospheric oxygen.

2. Description of the Prior Art

In currently used "water cooled" internal combustion engines liquid is forcefully circulated by a water pump, through a cooling circuit including the engine coolant jacket and an air cooled radiator. This type of system encounters the drawback that a large volume of water is required to be circulated between the radiator and the coolant jacket in order to remove the required amount of heat.

Due to the large mass of water inherently required, the warm-up characteristics of the engine are undesirably sluggish. For example, if the temperature difference between the inlet and discharge ports of the coolant jacket is 4 degrees, the amount of heat which 1 Kg of water may effectively remove from the engine under such conditions is 4 Kcal. Accordingly, in the case of an engine having an 1800 cc displacement (by way of example) operated full throttle, the cooling system is required to remove approximately 4000 Kcal/h. In order to achieve this, a flow rate of approximately 167 liter/-min must be produced by the water pump. This of course undesirably consumes several horsepower produced by the engine. Further, the weight of the large amount of coolant adds undesirably to the overall weight of the vehicle.

Japanese Patent Application Second Provisional Publication No. Sho. 57-57608 discloses an arrangement which has attempted to vaporize a liquid coolant and use the gaseous form thereof as a vehicle for removing heat from the engine. In this system the radiator and the coolant jacket are in constant and free communication via conduits whereby the coolant which condenses in the radiator is returned to the coolant jacket little by little under the influence of gravity.

This arrangement, while eliminating the power consuming coolant circulation pump which plagues the above mentioned arrangement, has suffered from the drawbacks that the radiator, depending on its position with respect to the engine proper, tends to be at least partially filled with liquid coolant. This greatly reduces the surface area via which the gaseous coolant (for example steam) can effectively release its latent heat of vaporization and accordingly condense, and thus has lacked any notable improvement in cooling efficiency. Further, with this system, in order to maintain the pressure within the coolant jacket and radiator at atmospheric level, a gas permeable water shedding filter is arranged to permit the entry of air into and out of the system.

However, this filter permits gaseous coolant to readily escape from the system, inducing the need for frequent topping up of the coolant level. A further problem with this arrangement is that some of the air, which is sucked into the cooling system as the engine cools, tends to dissolve in the water, whereby upon start up of the engine, the dissolved air tends to come out of solution and forms small bubbles in the radiator which adhere to the walls thereof and form an insulating layer. The undissolved air also tends to collect in the upper section of the radiator and inhibit the convection-like circulation of the vapor from the cylinder block to the radiator. This of course further deteriorates the performance of the device.

When the engine is not in use, the air which is permitted into the system via the air-permeable filter tends to induce rapid corrosion of particularly the upper sections of the radiator which are not immersed in liquid coolant due to exposure to atmospheric oxygen. Thus, because the system is not completely filled with coolant, as in the case of the circulation type systems, the addition of anti-corrosive agents to the coolant cannot prevent rapid deterioration of the exposed sections of the radiator and the like.

European Patent Application Provisional Publication No. 0 059 423 published on Sept. 8, 1982 discloses another arrangement wherein liquid coolant in the coolant jacket of the engine is not forcefully circulated therein and permitted to absorb heat to the point of boiling. The gaseous coolant thus generated is adiabatically compressed in a compressor so as to raise the temperature and pressure thereof and thereafter introduced into a heat exchanger (radiator). After condensing, the coolant is temporarily stored in a reservoir and recycled back into the coolant jacket via a flow control valve.

This arrangement has suffered from the drawback that when the engine is stopped and cools down the coolant vapor condenses and induces sub-atmospheric conditions which tend to induce air to leak into the system. This air tends to be forced by the compressor along with the gaseous coolant into the radiator.

Due to the difference in specific gravity, the above mentioned air tends to rise in the hot environment while the coolant which has condensed moves downwardly. The air, due to this inherent tendency to rise, tends to form pockets of air which cause a kind of "embolism" in the radiator and badly impair the heat exchange ability thereof.

FIG. 1 shows an evaporative type cooling system described in U.S. Pat. No. 4,367,699 issued on Jan. 11, 1983 in the name of Evans. This arrangement features a separation tank 6 wherein gaseous and liquid coolant are initially separated. The liquid coolant is fed back to the cylinder block 7 under the influence of gravity while the relatively dry gaseous coolant (steam for example) is condensed in a fan cooled radiator 8.

The temperature in the radiator is controlled to a predetermined constant level by selective energizations of the fan 9 which maintains a rate of condensation therein sufficient to provide a liquid seal at the bottom of the device. Condensate discharged from the radiator via the above mentioned liquid seal is collected in a small reservoir-like arrangement 10 and pumped back up to the separation tank via a small constantly energized pump 11.

This arrangement, while providing an arrangement via which air can be initially purged to some degree from the system, tends to suffer from rapid loss of coolant when operated at relatively high altitudes, due to the nature of the arrangement which permits said initial non-condensible matter to be forced out of the system. Once the engine cools, air is relatively freely admitted back into the system. The provision of the bulky separation tank 6 also renders engine layout difficult, increases the weight of the system and induces the additional problem that the level of coolant in the coolant jacket cannot be assuredly maintained under all modes of engine operation.

When the engine is stopped or "shut-down", as the condensor is completely drained of coolant and filled with atmospheric air and the level of coolant in the separation tank lowered, the interior of the condensor, separation tank and conduiting etc., are subject to rapid corrosion due to exposure to the oxygen in the air. This corrosion tends to rapidly reduce the usable life of the system and requires troublesome and expensive parts replacement from time to time. The addition of anti-corrosive agents to the coolant does not alleviate the problem.

Japanese Patent Application First Provisional Publication No. 56-32026 discloses an arrangement wherein the structure defining the cylinder head and cylinder liners is covered with a porous layer of ceramic material and wherein coolant is sprayed into the cylinder block from shower-like arrangements located above the cylinder heads. The interior of the coolant jacket defined within the engine proper is essentially filled with gaseous coolant during engine operation at which time liquid coolant is sprayed onto the ceramic layers.

This arrangement, while requiring very little liquid coolant, has proven totally unsatisfactory in that, upon boiling of the liquid coolant absorbed into the ceramic layers, the vapor thus produced and which escapes toward and into the coolant jacket, inhibits the penetration of fresh liquid coolant into the layers and induces the situation wherein rapid overheat and thermal damage of the ceramic layers and/or engine soon results. Further, this arrangement is of the closed circuit type and is plagued with air contamination and blockages in the radiator similar to the compressor-equipped arrangement discussed above.

FIG. 2 shows a system disclosed in U.S. Pat. No. 1,787,562 published on Jan. 6, 1931 in the name of L. P. Barlow. In this arrangement the coolant vapor which is condensed in the radiator 16 is first collected in the lower tank 17 of the radiator 16 and then transferred to a larger reservoir 18. The collected coolant is returned to the coolant jacket 20 via a pump 22 which is controlled by a float type level sensor arrangement disposed in the upper section thereof.

The pump 22 communicates with the coolant jacket 20 via a conduit 24 which is formed with a U-bend 25. This bend limits the amount of coolant which can drain back through the conduit 24 toward the reservoir 18. The interior of the radiator 16 and the reservoir 18 are both vented to the atmosphere via a conduit 26 and vent port 27 arrangement which fluidly interconnects the top of the reservoir 18 with lower tank 17 of the radiator.

Accordingly, this arrangement also suffers from the problem that during non-use the interior of the radiator 16 and the upper section of the engine coolant jacket 20 are constantly exposed to atmospheric oxygen and accordingly prone to undergo rusting and the like deterioration. A further drawback encountered with this device is that the cooling fan 28 is constantly driven by the engine and not controlled in response to the amount of heat actually produced by the engine and thus is apt to consume unecessary energy.

FIG. 3 shows an arrangement which is disclosed in U.S. Pat. No. 4,549,505 issued on Oct. 29, 1985 in the name of Hirano. The disclosure of this application is hereby incorporated by reference. For convenience the same numerals as used in the above mentioned patent are also used in FIG. 3.

While solving many of the drawbacks encountered with the previously disclosed prior art by completely filling the interior of the coolant jacket, radiator and associated conduiting which define the closed loop cooling circuit, with liquid coolant when the engine is not in use and effecting steps which purge any air which may leak in with the passing of time or during modes of operation when the pressure in the cooling circuit is rendered subatmospheric, this arrangement has itself suffered from the drawbacks that it requires a relatively large amount of liquid coolant and a correspondingly large reservoir. This increases the weight of the system undesirably. The system also employs no less than four electromagnetic valves to enable the required coolant management to be effected. This, while permitting the variation of the temperature at which the coolant boils with respect to the instant engine speed and load, notably increases the complexity and cost of the system.

Further, in the event that one of the valves malfunctions, the operability of the whole system is apt to be placed in jeopardy and likely to result in engine damage or temporary inoperability.

SUMMARY OF THE INVENTION

It is an object of the present invention to provide an evaporative type cooling system for an internal combustion engine which requires the minimum amount of coolant to enable the control of the heat exchange ability of the engine and to prevent corrosion of the parts of the system most susceptible to the same during non-use periods.

In brief, the above object is achieved by an evaporative cooling system which features a reservoir which contains only sufficient coolant to fill the radiator when the engine is not in use. The remaining sections of the cooling circuit such as the upper section of the coolant jacket which are fairly resistant to corrosion are filled with air during non-use periods. The air is suitably purged out during engine warm-up and operation in accordance with the temperature differential between the coolant jacket and the bottom of the radiator.

More specifically, a first aspect of the present invention takes the form of a cooling system for an internal combustion engine having a structure subject to high heat flux which is characterized by: a coolant jacket disposed about the structure and into which coolant is introduced in liquid form, permitted to boil and discharged in gaseous form; a radiator in fluid communcation with the coolant jacket which receives coolant vapor produced therein and condenses it to its liquid form, the radiator including a small collection vessel disposed at the bottom thereof; a reservoir in which coolant is stored, the reservoir being fluidly interposed between the collection vessel of the radiator and the coolant jacket, the reservoir being sized so as to contain sufficient liquid coolant to fill the radiator but insufficient to fill the radiator and the coolant jacket; means for returning condensate from the radiator to the coolant jacket in a manner which maintains the level of liquid coolant in the coolant jacket at a predetermined level; a first temperature sensor disposed in the radiator; a second temperature sensor disposed in the coolant jacket; a device associated with the radiator, the device being responsive to at least one of the first and second temperature sensors for varying the rate of condensation of the coolant vapor in the radiator; and a valve responsive to the first and second temperature sensors which selectively controls communication between one of the interior of the reservoir and the ambient atmosphere and the reservoir and the radiator.

A second aspect of the present invention resides in a method of cooling a internal combustion engine which is characterized by the steps of: introducing liquid coolant into a coolant jacket, permitting the coolant to boil and discharging coolant vapor; condensing the coolant vapor discharged from the coolant jacket in a radiator to form a condensate; storing a limited volume of liquid coolant in a reservoir, the limited volume being sufficient to fill the radiator but insufficient to fill both the radiator and the coolant jacket; establishing fluid communication between the reservoir and a lower portion of the radiator; returning the condensate formed in the radiator to the reservoir in a manner which maintains a highly heated structure of the engine immersed in a predetermined depth of liquid coolant; sensing the temperature of the condensate formed in the radiator; sensing the temperature of the coolant in the coolant jacket; controlling a device associated with the radiator in a manner which varies the rate of condensation of the coolant vapor therein; and selectively controlling one of the communication between the interior of the reservoir and the ambient atmosphere and the communication between the reservoir and the radiator in response to the condensate temperature sensing and coolant temperature sensing steps.

DETAILED DESCRIPTION OF THE PREFERRED EMBODIMENTS

Figure 4:
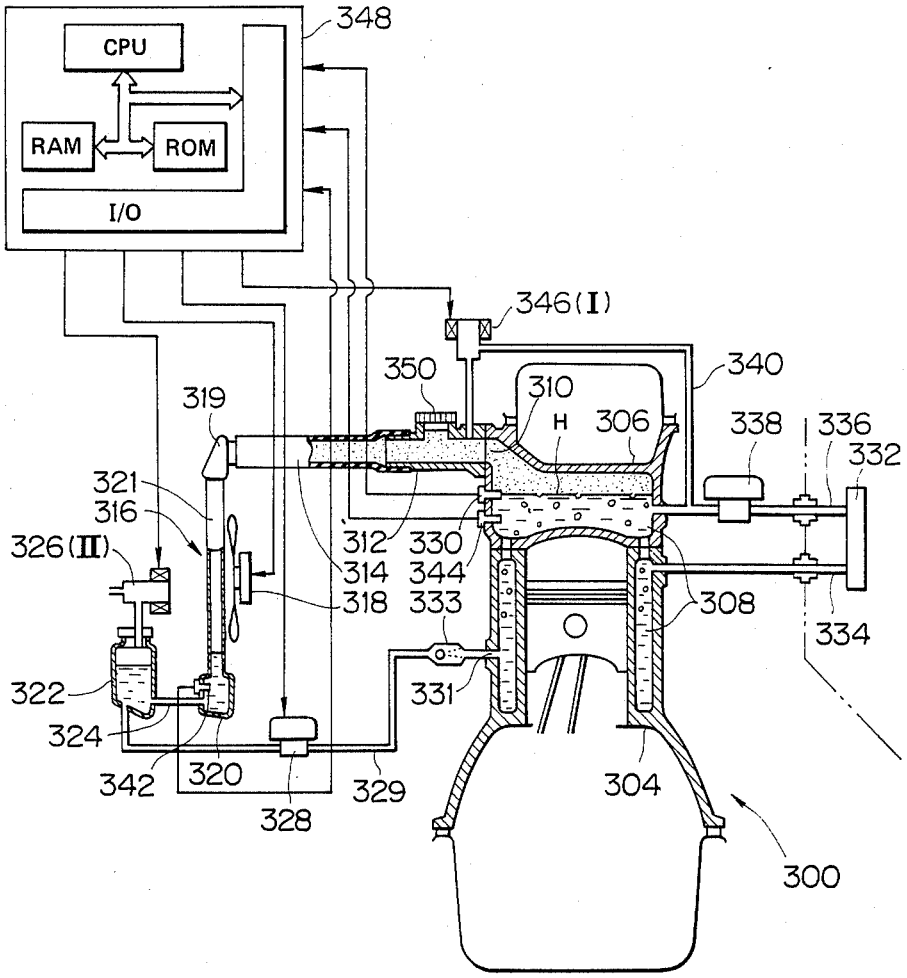
FIGS. 4 and 5 show an embodiment of the present invention.
Figure 5:
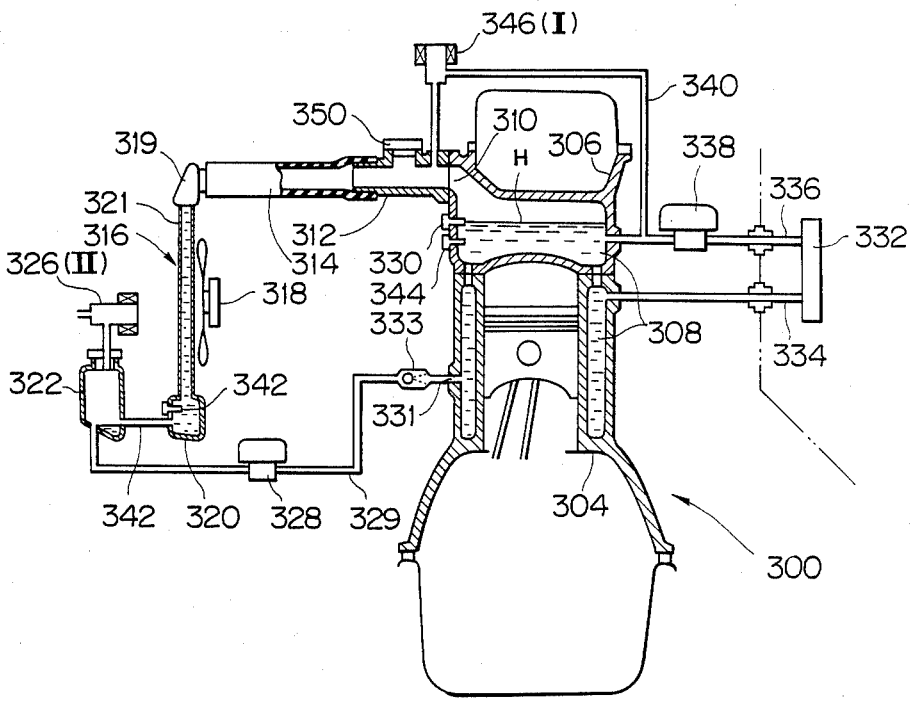

FIGS. 4 and 5 of the drawings show an engine system to which a first embodiment of the invention is applied. In this arrangement an internal combustion engine 300 includes a cylinder block 304 on which a cylinder head 306 is detachably secured. The cylinder head and block are formed with suitable cavities which define a coolant jacket 308 about the structure of the engine subject to high heat flux (e.g. combustion chambers, exhaust valves conduits, cylinder walls etc.,).

Fluidly communicating with a vapor discharge port 310 formed in the cylinder head 306 via a vapor manifold 312 and vapor conduit 314 is a condensor 316 or radiator as it will be referred to hereinafter. Located adjacent the radiator 316 is a selectively energizable electrically driven fan 318 which is arranged to induce a cooling draft of air to pass over the heat exchanging surfaces thereof upon being put into operation.

In order to take full advantage of the natural draft of air which occurs when a vehicle is driven along a road or the like, and to minimize the need to energize fan 318, the radiator 316 is preferably disposed at a well ventilated location such as near the forward end of the vehicle.

Radiator 316 in this embodiment takes the form of upper and lower tanks 319, 320 which span the width of the device and a plurality of relatively small cross-section vertically extending tubes 321 interconnecting the same. In this instance the lower tank 320 is formed in a manner to have a larger internal volume than the upper one and thus to function as a small collection reservoir or vessel.

A small coolant reservoir 322 is arranged to constantly communicate with the lower tank 320 via a supply/discharge conduit 324. In this embodiment the reservoir 322 is arranged adjacent the lower tank 320 and arranged to be selectively communicable with the ambient atmosphere through a (second) electromagnetic valve 326. For simplicity the valve 326 is mounted on a cap (no numeral) which can be selectively removed from the reservoir 322. However, arrangements wherein the valve 326 is permanently mounted on the reservoir 322 and the cap provided as an independent member are also within the scope of the present invention.

The reservoir 322 is sized so as to contain just a little more coolant than is required to fill the radiator 316. This minimizes the weight of the excess coolant which must be carried with the system for shut-down and/or temperature control purposes and thus reduces the weight of the overall system as compared with the prior art arrangements discussed hereinbefore.

A small capacity electrically driven pump 328 is disposed in a coolant return conduit 329 which leads from the reservoir 322 to an inlet port 331 formed at the bottom of the section of the coolant jacket 308 formed in the cylinder block 304. A one-way valve 333 is disposed in conduit 330 between port 331 and pump 328 to prevent coolant from flowing back toward the reservoir 322.

The capacity of pump 328 is selected to be such that it pumps coolant at a rate slightly greater than the maximum requirement of the cooling system. This rate can be approximated using parameters such as the amount of fuel combusted in the engine per unit time and confirmed by empirical results. It is important that the rate at which the pump 328 pumps be higher than the maximum requirement so that during engine operation the maintainance of the desired level of coolant in the coolant jacket will be assured under all modes of operation.

In the event that pump 328 is of the type which inhibits coolant flow therethrough when de-energized one-way valve 333 can be omitted.

It will be noted that as the pump 328 inducts from the reservoir 322 and not directly from the lower tank 320, an advantage is derived in that pump cavitation due to thermal saturation of the system tends to be obviated. Thus, if the engine is operated at high speed/load conditions for a prolonged period (for example), the condensate at the bottom of the radiator 316 and the associated structure tends to approach the boiling point of the coolant whereby the coolant, upon being inducted into the pump 328, tends to boil and vapor lock the same. As the condensate from the radiator 316 is first fed to the reservoir 322 the total volume of liquid coolant upstream of the pump is increased, thereby increasing the time available for the temperature of the coolant to drop to the point whereat the cavitation phenomenon tends to be prevented.

Figure 1:
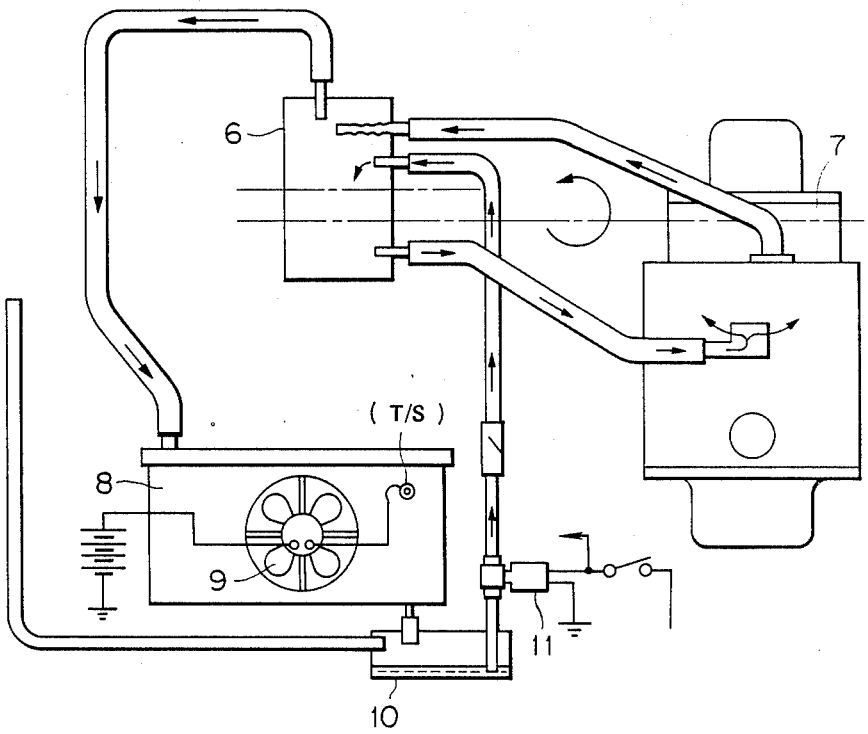
FIG. 1 (PRIOR ART)
FIGS. 1 to 3 show three of the prior art arrangements discussed in the opening paragraphs of the instant disclosure.
Figure 2:
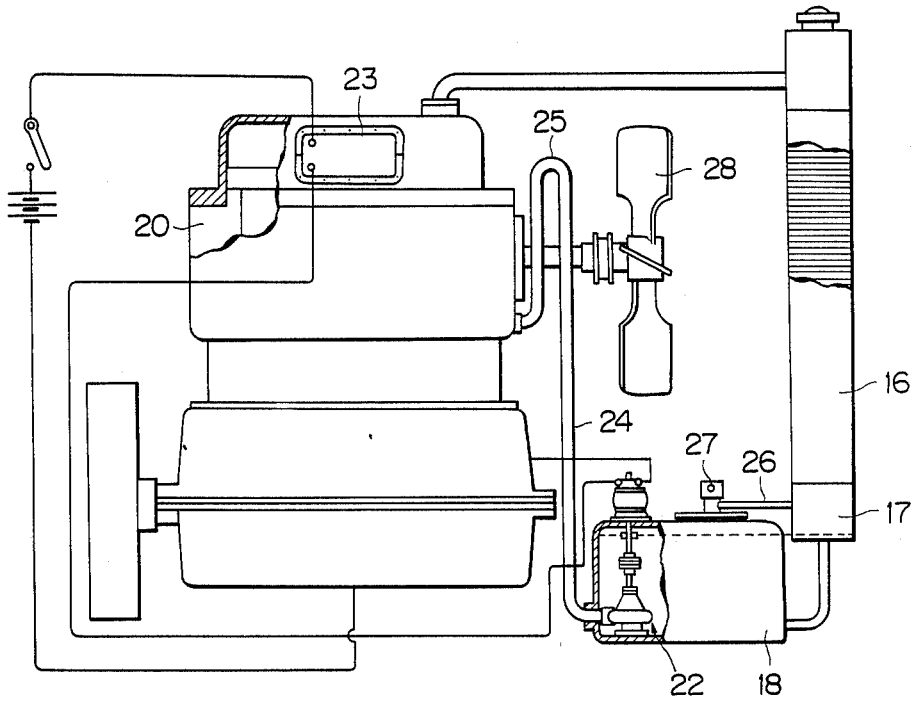
FIG.2 (PRIOR ART)
Figure 3:
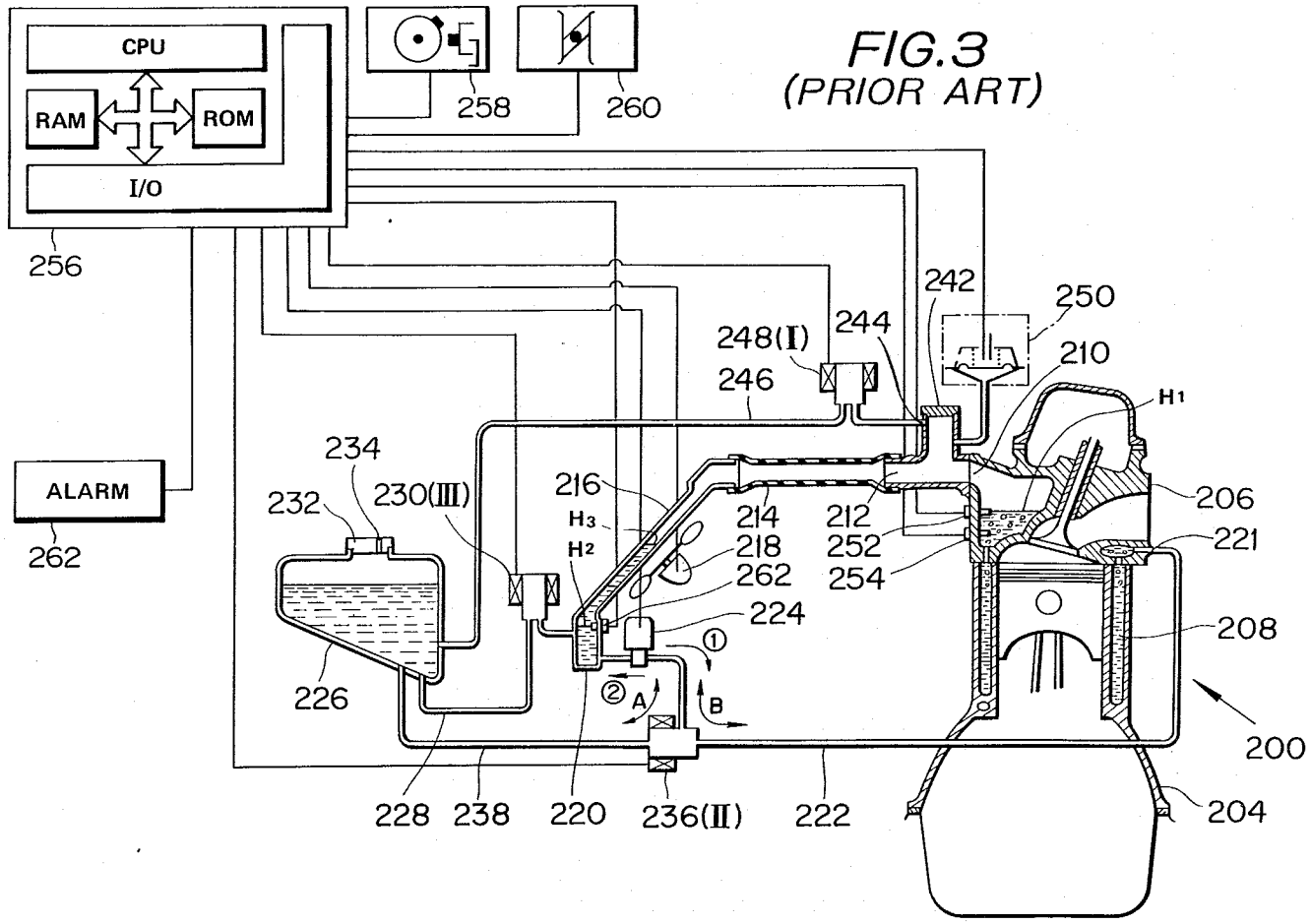
FIG. 3 (PRIOR ART)

However, it should be appreciated that the invention is not limited to such a particular connection and that it is possible if so desired to utilize a system wherein the reservoir 322 is maintained constantly at atmospheric pressure, the pump 328 is communicated with the lower tank 320 and a valve is interposed between the reservoir and the lower tank in a manner similar to the arrangement illustrated in FIG. 3.

In order to control the pump 328, a level sensor 330 is disposed in the coolant jacket 308 and arranged to sense the level of coolant falling below the predetermined level H. In this embodiment H is selected to ensure that the engine structure which is subject to high heat flux (viz., the cylinder head, exhaust ports and valves etc.,) remains constantly immersed in a depth of liquid coolant sufficient to ensure constant immersion even under heavy load operation when the boiling of the coolant becomes sufficiently vigorous and tends to induce localized dry-outs and cavitation. These phenomena are apt to cause localized overheating which can lead to serious engine damage. Level H is also selected in a manner to define a coolant vapor collection space in the coolant jacket 308 above the surface of the liquid to permit the vapor generated to accumulate and flow without undue restriction toward the vapor discharge port or ports 310 into the vapor manifold 312.

The level sensor 330 may take the form of a float and reed switch combination. It is deemed advantageous to arrange the level sensor 330 to output a signal when the coolant level is above H. With this, if the sensor 330 fails the pump will be continuously energized ensuring that excess coolant rather than the reverse is supplied into the coolant jacket 308.

A vehicle cabin heating arrangement comprises a heater core 322, a induction conduit 334, a discharge conduit 336 and a circulation pump 338 disposed in the discharge conduit 336. The induction conduit 334 is arranged to communicate with a section of the coolant jacket 308 formed in the cylinder block 308 while the discharge conduit 336 communicates with a section of the coolant jacket 308 which is formed in the cylinder head 306. The discharge conduit 336 is arranged to discharge coolant which has passed through the heater core 332 into the coolant jacket 308 at a level which is lower than the above mentioned level H.

The operation of the circulation pump 338 is controlled in accordance with a manually operable switch (not shown).

It will be noted that it is possible to reverse the arrangement of the induction and discharge conduits 334, 336 and arrange for the induction conduit 334 to communicate with the coolant jacket 308 at a level higher than level H and thus enable the circulation of coolant vapor through the heater core 332 and take advantage of the large amount of heat (latent heat of evaporation) contained therein.

A blending conduit 340 is arranged to communicate the cabin heating circuit at a point downstream of the circulation pump 338 discharge port and the vapor manifold 312. When the heater circulation pump 338 is energized a fraction of the coolant which would normally be directly returned to the coolant jacket is caused to flow through the blending conduit 340, enter the vapor manifold 312 and vapor transfer conduit 314 and flow into the radiator 316. Thus, during operation of the engine 300 during weather which is cold enough to induce the need for cabin heating, liquid coolant from the coolant jacket 308 is circulated in limited quantities to the radiator 316. This obviates the tendancy for the concentration of the anti-freeze and anti-corrosive additives to build up in the coolant jacket 308 due to the "distillative" nature of the system and obviates the situation wherein the coolant in the radiator 316 and other elements of the system, which are the most prone to "freezing" in cold environments, is not depleted of anti-freeze etc.

If desired the vapor manifold 312 may also be provided with a liquid/vapor separator arrangement (not shown) at a location downstream of the vapor discharge port 310 and upstream of the point at which blending conduit 340 merges therewith.

If deemed necessary this device may include baffles or the like to improve the separation efficiency and/or take the form of arrangements disclosed in U.S. Pat. No. 4,499,866 issued on Feb. 19, 1985 in the name of Hirano, U.S. Pat. No. 4,570,579 issued on Feb. 18, 1986 in the name or Hirano, copending U.S. patent application Ser. No. 757,537 filed on July 3, 1985 in the name of Hayashi et al, and copending U.S. patent application Ser. No. 866,259 filed on May 23, 1986 in the name of Shimonosono. The contents of these references are hereby incorporated by reference thereto. These documents disclose arrangements which separate liquid coolant from coolant vapor by subjecting the effluent from the coolant jacket to a number of changes in direction and/or a kind of centrifugal separation.

The provision of these types of liquid/vapor separating devices minimizes the amount of liquid coolant which is apt to flow uncontrolled through the vapor transfer conduit 314 and find its way into the radiator 316. During high speed/high load engine operation, for example, a relatively large amount of fuel is fed to and combusted in the combustion chambers of the engine. This produces a large amount of heat which induces extremely vigorous boiling in and around the cylinder head of the engine. The bumping and frothing which accompanies this vigourous boiling tends to induce the discharge of a relatively large amount of liquid coolant into the vapor manifold 312. The liquid coolant, if permitted to enter the upper tank 319 of the radiator 316, tends to wet and thus insulate the interior of the conduits 321 to the point whereat the "dry" surface area available for the coolant vapor to release its latent heat of evaporation is reduced and the heat exchange capacity of the radiator is adversely effected. This induces the possibility of engine overheat due to the inability to release sufficiently large amounts of heat.

In view of the above, the blending conduit 340 is so constructed and arranged with the heating circuit that the maximum amount of liquid coolant which can be introduced into the vapor manifold 312 and transfer conduit 314 via the blending conduit 340 is limited to a volume which does not adversely influence the heat exchange capacity of the radiator 316 but simultaneously ensures that the concentration of anti-freeze and rust inhibiting agents added to the engine coolant does not undesirably concentrate in the coolant jacket 308.

A (first) temperature sensor 342 is disposed in the lower tank 320 and arranged to sense the temperature ($T_C$) of the coolant which has collected therein.

A (second) temperature sensor 344 is disposed in the coolant jacket 308 proximate the most highly heated engine structure and arranged to be immersed in the liquid coolant. The immersion of the sensor 344 in liquid coolant stabilizes the output thereof, ensuring error free sensing of the engine temperature ($T_E$) even when the coolant is boiling and bumping vigorously. In this position, in the event that the liquid coolant falls to a dangerously low level, the output of the sensor suddenly rises due to direct exposure to heat radiation and can be used to indicate a system malfunction if so desired.

A normally open electromagnetic valve 346 is disposed in the blending conduit 340 and arranged to be closed and cut-off fluid communication between the heating circuit and the vapor manifold 312 when the temperature of the coolant in the coolant jacket is detected by the temperature sensor 344 as being below a predetermined level. In this embodiment the level is selected to be 85° C.

The outputs of temperature sensors 342 and 344 are fed to a control circuit 348 which includes a microprocessor. As shown this device includes a CPU, RAM, ROM and I/O board. The ROM of the microprocessor contains control programs which process the inputs of the two temperature sensors 342, 344 in a manner which will be detailed hereinlater and which generates control commands via which the fan 318, coolant return pump 328 and electromagnetic valves 326 and 346 are suitably energized.

Prior to initially being put into operation the cooling jacket is filled via a filler port formed in the vapor manifold 312 with sufficient liquid coolant to being the level therein to level "H", and a cap 350 is set in place the hermetically closes the same. A quantity of liquid coolant selected to essentially fill the radiator 316 is introduced into the reservoir 322, and the cap thereof set in place. As communication between the reservoir 322 and the lower tank 320 is unrestricted in this embodiment, the coolant in the system assumes levels essentially as shown in FIG. 4. The coolant contains metered quantities of suitable anti-freeze and anti-corrosive additives.

When the engine 300 is started, as the level of coolant is at level H, coolant return pump 328 is not energized, and the stagnant coolant in the coolant jacket 308 rapidly reaches the point of producing coolant vapor. It will be noted that the warm-up characteristics of this embodiment are quicker than those of the prior art arrangement shown in FIG. 3 as the amount of coolant in the coolant jacket under "cold" engine start conditions is less than that of the prior art arrangement by the volume defined in the coolant jacket above level "H".

As the amount of vapor generated increases, the air in the coolant jacket which is colder and denser than the coolant vapor is forced toward and into the radiator 316 and finally caused to bubble up through the coolant in the reservoir 322. At this time valve 326 is maintained open to permit ready purging of the non-condensible matter.

Upon the temperature differential between the coolant jacket 308 and the lower tank 320 falling to a predetermined value, valve 326 is conditioned to assume a closed state and render the system closed circuit.

Figure 6:
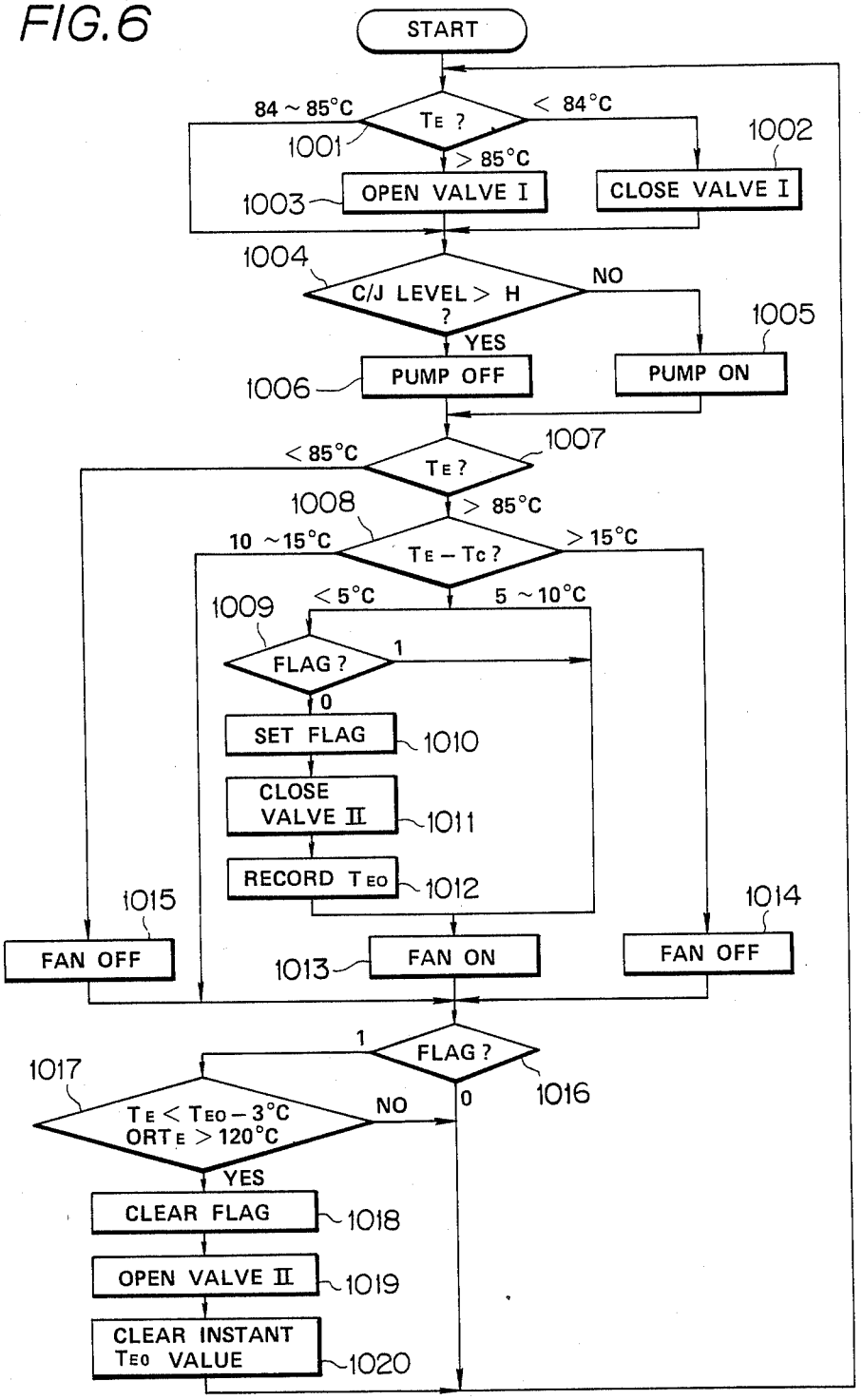
FIGS. 6 and 7 show flow charts which depict the steps which characterize the operation of the embodiment of the present invention.
Figure 7:
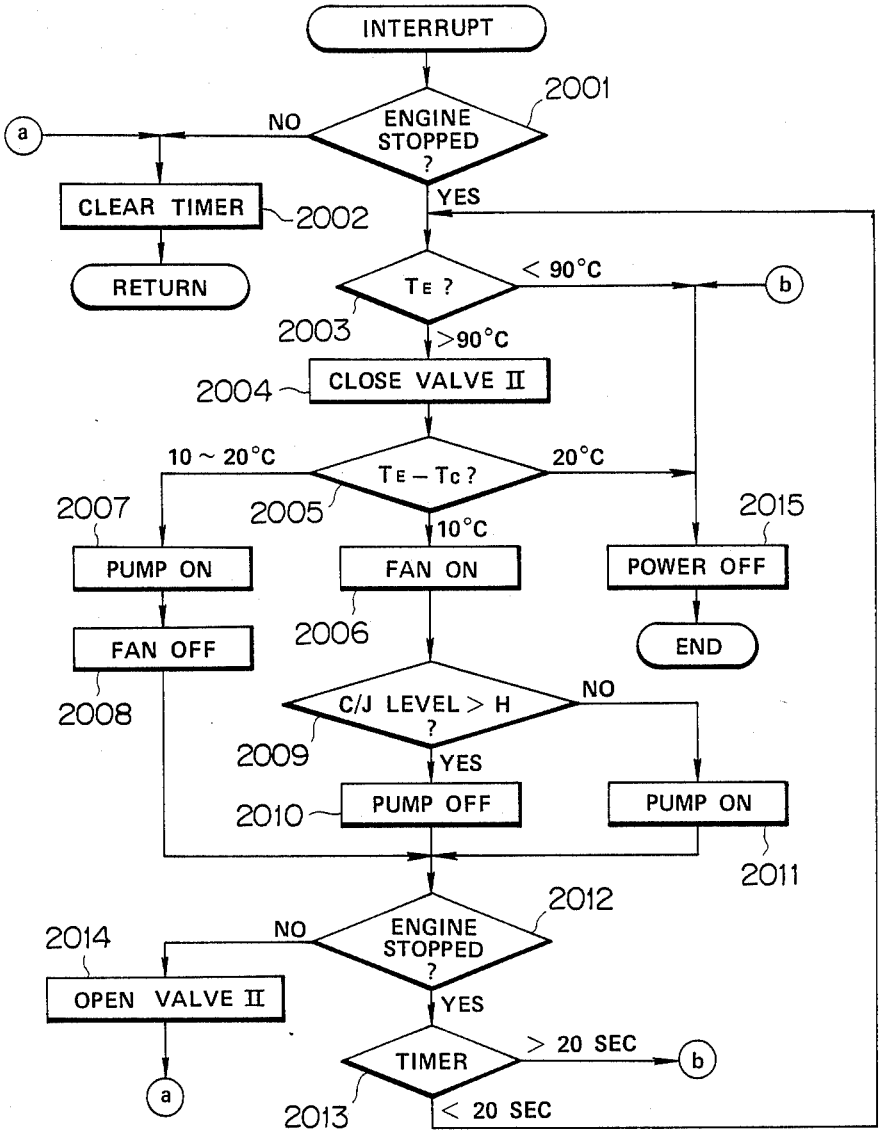

The above operation along with the steps involved with the "shut down" of the system will become more clearly understood from the following description of the flow charts shown in FIGS. 6 and 7.

The first step 1001 of the program shown in FIG. 6 is such as to sample the output of temperature sensor 344 ($T_E$) and compare it with a predetermined value. In the event that the temperature is below a preselected minimum value of 84° C. then a command is issued to close valve 346 (valve I). This ensures that during very cold weather or the like, even if the heater circulation pump 342 has been energized by the cabin occupants, coolant will not be circulated via blending conduit 340 toward the radiator 316 and permit heat to be released thereby at a time when it is desired to raise the temperature of the coolant in the coolant jacket 308 as rapidly as possible. Advantageously, this also ensures that all of the heat which must be removed during this "warm-up" mode is directed to cabin heating.

If the temperature of the coolant is found to be in the range of 84°-85° C. then the program flows to step 1004 and, bypassing step 1003 until such time as the temperature exceeds 85° C.

At step 1004 the output of level sensor 330 is sampled and in the event that sufficient coolant has been vaporized to the lower the level below "H" then the pump is energized at step 1005. On the other hand, if the level is found to be sufficient then the program flows to step 1007 via step 1006. At step 1007 the coolant jacket temperature ($T_E$) is ranged against a value of 85° C. Until the coolant exceeds this value, steps 1009 to 1014 are bypassed, and the program goes to step 1015 wherein a command to stop the operation of fan 318 is issued.

Upon the system warming to the point where the output of temperature sensor 334 indicates that the temperature ($T_E$) is above 85° C., the temperature differential between the coolant jacket and the lower tank ($T_C$) is ranged at step 1008. In the event that the temperature differential is greater than 15° C. (by way of example) then it is deemed that either the engine temperature is still rising or alternatively the ambient conditions are inducing sufficient heat to be removed from the radiator 316 as to not require the energization of the cooling fan 318.

If the temperature differential is found to be within 5°-10° C., then it is assumed that the level of liquid coolant in the radiator has lowered sufficiently and the liquid/vapor interface is approaching the level of the lower tank 320, and at step 1013 a command to energize fan 318 is issued.

If the temperature differential is found to be as low as 5° C., then it is assumed that the level of liquid in the radiator 316 and lower tank 320 has reached its minimum permissible level, and at step 1009 the status of a flag is determined. If the flag is found to be "0", then it is set to "1" at step 1010. On the other hand, if the flag has been previously set to "1", then the program flows directly to step 1013. Following the setting of the flag to "1", a command to close valve II (viz., valve 326) is issued at step 1011 to place the system in a hermetically sealed closed circuit state. At step 1012 the output of temperature sensor 344 is read, and the value stored in RAM as $T_{EO}$.

At step 1016 the instant status of the flag is determined. In the event that it has been set to "1", then at step 1017 the instant temperature coolant jacket temperature ($T_E$) is sampled and ranged against (a) the currently stored value of $T_{EO}$ and (b) a predetermined maximum permissible value of 120° C.

While the value of TE remains within the limits $T_E < T_{EO} - 3°$ C. and $T_E > 120°$ C. the program recycles to step 1001 while in the event that the instant engine temperature $T_E$ is out of the range, then steps 1018, 1019 and 1020 are executed. In these steps the flag is reset to "0", valve 326 is opened and the instant value of $T_{EO}$ is cleared from RAM. This allows for both overheated and overcooled conditions, i.e., this permits control of the situation wherein the pressure and temperature in the system have risen excessively (probably due to the presence of some remaining air in the radiator) and permits the excess pressure to be vented in a manner which will cause non-condensible matter to be purged out of the system via a momentary opening of valve 326, or permit the control of the situation wherein a momentary overcooling of the radiator 316 has lowered the internal pressure in the system and permit liquid coolant from the reservoir 322 to be inducted in a manner which both increases the pressure and adjusts the available dry heat exchanging surface of the radiator.

FIG. 7 is a flow chart depicting the characterizing steps of an interrupt routine which is performed at regular intervals during the running of the system control routine shown in FIG. 6. The purpose of this routine is to determine if the engine has been stopped and there is a need to excecute a "shut-down" control. As shown in step 2001 of this routine, the instant status of the engine is determined by sampling the output of an engine ignition switch, engine speed sensor or the like. In the event that the engine is still running, then at step 2002 the current count of a timer (soft clock or the like) is cleared and the program returns to the control routine of FIG. 6.

On the other hand, if the engine has been stopped, then at step 2003 the output of temperature sensor 344 is sampled, and the instant engine temperature is compared with a single value of 90° C. If the temperature is found to be below 90° C., then the program flows directly to step 2015 wherein a command to terminate the supply of power to the entire system is used. However, while the temperature of the coolant in the coolant jacket 308 is above 90° C., then a command is issued (step 2004) to close valve II (valve 326). This prevents the possibility of a "blow out" of coolant from the cooling circuit due to the presence of super-atmospheric pressures therein.

At step 2005 the temperature differential ($T_E - T_C$) between the coolant jacket 308 and the lower tank 320 is ranged. In the event the temperature differential is equal to or greater than 20° C., then it is assumed that it is safe to render the system open circuit and the program goes to step 2015.

If the temperature differential is equal to or less than 10° C., then it is assumed that the system is still too hot to be rendered open circuit and that further quantities of heat need to be released to the atmosphere. To speed this process, a command is issued at step 2006 to energize fan 318.

On the other hand, if the temperature differential is found to be in the range of 10°–20° C., then it is assumed that the radiator 316 is partially filled with liquid coolant, and at steps 2007 and 2008 commands to stop the operation of the coolant return pump 328 and the fan 318 are issued. As a result, with the radiator 316 partially filled, even if the fan 318 is strongly energized, very little increase in heat exchange between the radiator and the ambient atmosphere will be achieved, and thus, for the sake of conserving electrical power, neither the pump 328 nor the fan 318 is operated under these conditions.

Following the energization of fan 318 in step 2006, the coolant level in the coolant jacket (C/J) is determined (step 2009). As the engine is still hot and the coolant still boiling or close thereto, pump 328 is selectively energized in steps 2010 and 2011 to ensure that no localized dryouts or the like occur in the upper section of the coolant jacket. This obviates any chance of thermal damage.

At step 2012 the fact that the engine 300 is in fact stopped is confirmed, and at step 2013 a timer is set counting. While the count remains below a predetermined count (indicative of 20 seconds by way of example), the program is directed to step 2003. Upon exceeding this value the program goes to step 2015 wherein power to the system is cut-off.

On the other hand, if the engine is found to be running in step 2012, then at step 2014 a command to open valve 326 is issued, and the program returns via step 2002.

Thus, as will be understood, the cooling system is kept operational for a maximum period of 20 seconds following engine stoppage. If during this period either the engine temperature ($T_E$) or the differential between the coolant jacket and the lower tank indicate that it is safe to render the system open circuit without any detremental effects, the power to the system is cut-off prior to the expiry of the predetermined period.

When the power to the system is cut-off in step 1015, valve 326 is de-energized and renders the system open circuit. As the coolant vapor in the circuit condenses, the resulting pressure differential which develops between the atmosphere and interior of the cooling circuit causes the coolant stored in the reservoir 322 to flow into the lower tank 320 via conduit 324. When the radiator 316 has been filled and the coolant in the reservoir 322 exhausted, air is permitted to be inducted into the lower tank 320. This air bubbles up through the tubing 321 of the radiator 316 and finds its way to the upper section of the coolant jacket 308 etc., until such time as the pressure differential therein cases to exist. Even though air is permitted to pass through the radiator 316 at this time, the latter remains filled and protected from corrosion and the like.

As will be appreciated, the concept which underlies the instant invention is not limited to the instant embodiment and can be applied to other evaporative cooling arrangements, such as that shown in FIG. 3 of the instant application, if so desired.

What is claimed is:

1. In an internal combustion engine having a structure subject to high heat flux a cooling system comprising:

a coolant jacket disposed about said structure and into which coolant is introduced in liquid form, permitted to boil and discharged in gaseous form;

a radiator in fluid communication with said coolant jacket which receives coolant vapor produced therein and condenses it to its liquid form, said radiator including a small collection vessel disposed at the bottom thereof;

a reservoir in which coolant is stored, said reservoir being fluidly interposed between the collection vessel of said radiator and said coolant jacket, said reservoir being sized so as to contain sufficient liquid coolant to fill said radiator but insufficient to fill said radiator and said coolant jacket;

means for returning condensate from said radiator to said coolant jacket in a manner which maintains the level of liquid coolant in said coolant jacket at a predetermined level;

a first temperature sensor disposed in said radiator;

a second temperature sensor disposed in said coolant jacket;

a device associated with said radiator, said device being responsive to at least one of said first and second temperature sensors for varying the rate of condensation of the coolant vapor in said radiator; and a first valve responsive to said first and second temperature sensors which selectively controls communication between one of the interior of said reservoir and the ambient atmosphere and said reservoir and said radiator.

2. An internal combustion engine as claimed in claim 1, wherein said level maintaining means comprises:

a level sensor disposed in said coolant jacket, said level sensor being arranged to sense the level of liquid coolant in said coolant jacket falling below said predetermined level and issue a signal indicative thereof, said predetermined level being selected to be such that said structure subject to high heat flux is immersed in a predetermined depth of liquid coolant;

a pump which pumps liquid coolant from said reservoir to said coolant jacket through a coolant return conduit, said pump being responsive to said level sensor in a manner to maintain the level of liquid in said coolant jacket at said predetermined level.

3. An internal combustion engine as claimed in claim 1, wherein said device takes the form of an fan which when energized increases the heat exchange between said radiator and a cooling medium surrounding said radiator.

4. An internal combustion engine as claimed in claim 3, wherein said fan is responsive to both said first and second sensors and arranged to assume a non-energized state when said first and second temperature sensors indicate that the temperature differential between said coolant jacket and said lower tank is less than a predetermined value.

5. An internal combustion engine as claimed in claim 1, further comprising one-way check valve means for preventing coolant from flowing from said coolant jacket to said reservoir via said coolant return conduit.

6. An internal combustion engine as claimed in claim 1, further comprising:

an auxiliary circuit in fluid communication with said coolant jacket;

a circulation pump disposed in said auxiliary circuit which is selectively energizable to circulate coolant therethrough;

a blending conduit which leads from said auxiliary circuit at a location downstream of said circulation pump and which is arranged to transfer a fraction of the output of said circulation pump to said radiator so as to prevent concentration in the coolant jacket of additives mixed with the coolant.

7. An internal combustion engine as claimed in claim 6, further comprising a second valve disposed in said blending conduit, said valve being responsive to the temperature of the coolant in said coolant jacket and arranged to remain closed to prevent the transfer of coolant through said blending conduit when said second temperature sensor indicates that the temperature of the coolant in said coolant jacket is below a predetermined minimum level.

8. In a method of cooling a internal combustion engine the steps of:

introducing liquid coolant into a coolant jacket, permitting the coolant to boil and discharging coolant vapor;

condensing the coolant vapor discharged from said coolant jacket in a radiator to form a condensate;

storing a limited volume of liquid coolant in a reservoir, said limited volume being sufficient to fill said radiator but insufficient to fill both said radiator and said coolant jacket;

establishing fluid communication between said reservoir and a lower portion of said radiator;

returning the condensate formed in said radiator to said reservoir in a manner which maintains a highly heated structure of said engine immersed in a predetermiend depth of liquid coolant;

sensing the temperature of the condensate formed in said radiator;

sensing the temperature of the coolant in said coolant jacket;

controlling a device associated with the radiator in a manner which varies the rate of condensation of coolant vapor therein; and selectively controlling one of the communication between the interior of said reservoir and the ambient atmosphere and the communicaton between said reservoir and said radiator in response to said condensate temperature sensing and coolant temperature sensing steps.

9. A method as claimed in claim 8, wherein said step of returning comprises the steps of:

sensing the level of coolant in said coolant jacket using a level sensor;

pumping liquid coolant from said reservoir to said coolant jacket in response to the level sensing step indicating that the level of liquid coolant in the coolant jacket is below a predetermined level.

10. A method as claimed in claim 8, wherein said step of controlling comprises: controlling a fan which increases the heat exchange between the radiator and a cooling medium surrounding the radiator.

11. A method as claimed in claim 8, wherein said step of controlling includes the steps of:

determining the value of the temperature differential which exists between the condensate collected at the bottom of said radiator and the coolant in said coolant jacket; and energizing said fan in response to the value of the temperature differential being less than a predetermined value.

12. A method as claimed in claim 8, further comprising the step of preventing coolant from flowing from said coolant jacket to said reservoir.

13. A method as claimed in claim 8, further comprising the step of filling the radiator with liquid coolant from said reservoir when the engine is not in use, by means of the pressure differential which develops between (a) said reservoir and (b) the coolant jacket and radiator as the coolant vapor in said coolant jacket and said radiator cool and condense to liquid.

14. A method as claimed in claim 8, further comprising the step of circulating a predetermined small amount of liquid coolant between said coolant jacket and the radiator to prevent the concentration in the coolant jacket of coolant additives.

15. A method as claimed in claim 14, further comprising the step of preventing said circulation when the temperature of the coolant in said coolant jacket is below a predetermined minimum level.

* * * * *